US009855482B1

(12) United States Patent
Dickinson

(10) Patent No.: US 9,855,482 B1
(45) Date of Patent: Jan. 2, 2018

(54) GOLF AID FOR IMPROVING SWING

(71) Applicant: Paul Dickinson, Montauk, NY (US)

(72) Inventor: Paul Dickinson, Montauk, NY (US)

( * ) Notice: Subject to any disclaimer, the term of this patent is extended or adjusted under 35 U.S.C. 154(b) by 0 days.

(21) Appl. No.: 15/434,693

(22) Filed: Feb. 16, 2017

Related U.S. Application Data

(60) Provisional application No. 62/389,008, filed on Feb. 16, 2016.

(51) Int. Cl.
*A63B 69/36* (2006.01)

(52) U.S. Cl.
CPC ..... *A63B 69/36* (2013.01); *A63B 2208/0204* (2013.01)

(58) Field of Classification Search
CPC ..... A63B 69/3632; A63B 69/0057; A63B 53/0487
USPC ..... 473/226, 227, 238, 239, 266, 276, 277, 473/296–299, 409
See application file for complete search history.

(56) References Cited

U.S. PATENT DOCUMENTS 1,669,457 A 5/1928 Dailey
2,801,106 A * 7/1957 Koehler ..... A63B 53/007 473/204
4,267,793 A * 5/1981 Lane ..... A63B 69/0002 116/203
4,688,800 A 8/1987 Lopez
7,147,568 B1 * 12/2006 Butler ..... A63B 53/007 403/109.4
7,235,020 B1 * 6/2007 Christensen ..... A63B 69/3617 473/226
7,789,765 B2 * 9/2010 Marini ..... A63B 53/007 473/206
7,798,910 B2 9/2010 Leadbetter et al.
8,435,129 B2 * 5/2013 Miller ..... A63B 69/3608 473/256
8,562,451 B2 10/2013 Crabtree
2004/0048679 A1 * 3/2004 Bunting ..... A63B 69/3632 473/226
2006/0183563 A1 * 8/2006 Nemeckay ..... A63B 57/00 473/239
2015/0375080 A1 * 12/2015 Boisvert ..... A63B 69/3632 473/239
2016/0250542 A1 9/2016 Petty et al.

* cited by examiner

*Primary Examiner* — Nini Legesse
(74) *Attorney, Agent, or Firm* — Galgano IP Law PLLC; Thomas M. Galgano; Jessica G. McDonald

(57) ABSTRACT

Golf training aid for improving a golfer's golf swing, insertable into a grip end of a golf club. The aid having a rod slidably connected to the grip end of the golf club, with the first end and a portion of the rod received within the hollow shaft of the golf club. A training element is connected to the second end of the rod and disposed outwardly beyond the grip end of the shaft of the golf club. The rod is slidably moveable from a retracted position to an extended position during a golf swing via gravity. In the retracted position, the training element is located adjacent the grip end of the golf club and a portion of the rod is received within the shaft. In the extended position, the rod is extended outwardly and the training element is spaced apart from the grip end of the golf club.

17 Claims, 10 Drawing Sheets

GOLF AID FOR IMPROVING SWING

CROSS-REFERENCE TO RELATED APPLICATION

This application claims benefit from U.S. Provisional Patent Application No. 62/389,008, filed Feb. 16, 2016, the contents of which are hereby incorporated by reference.

BACKGROUND OF THE INVENTION

1. Field of the Invention

The invention is generally in the field of golf training aids. More particularly, the present invention is a golf training aid which is removably insertable into the grip end of a shaft of a golf club, to help a golfer improve his/her golf swing.

2. Brief Description of the Prior Art

The most common difference between golfers who are great ball strikers versus poor ball strikers is both the difference in the downswing plane that the golf club swings on and the amount of lag that the golfer maintains. Lag is the ability for a golfer to establish an approximately 90 degree angle between the golfer's lead arm and the golf club shaft during the backswing and the ability to maintain such angle on the downswing until the final moments before releasing the club head into the golf ball. The closer the golfer is to establishing and maintaining a 90° angle between his/her lead arm and the golf club shaft, when the golfer's hands are aligned with the golfer's trailing leg and the golf club is parallel to the ground, the more lag the golfer has. Proper lag promotes even and steady acceleration of the club head which, in turn, produces a strong downward thrust, which adds distance, trajectory, and consistency, thus assuring dependable control of the distance of the golf ball. Any amount of deceleration during the downswing dissipates club head lag. Therefore, constant acceleration is needed to ensure a lagging club head through impact with the golf ball. As a result, golfers having a proper golf swing use steady acceleration of the club head and poor golfers typically over-accelerate the club head, resulting in the golfer's hands reaching maximum speed before impact, thus losing the lag.

The impact position of the golf club is directly affected by how much a golfer maintains lag on the downswing. Good ball strikers position the golf club parallel to the ground once his/her hands are aligned with his/her back thigh on the downswing, whereas poor ball strikers position the golf club shaft parallel to the ground when his/her hands are behind his/her back thigh on the downswing. Therefore, it is desirable to have a golf swing training aid that will assist a golfer in assuming a proper position on the downswing with his/her hands aligned with the trailing leg, when the golf club is parallel to the ground, and maintaining a 90 degree angle between the golfer's lead arm and the golf club shaft during the backswing and downswing, in order to strike the ball more effectively.

In addition to maintaining lag, the downswing plane of the golf club is vital in order to deliver the golf club path in a fashion to propel the golf ball on a straight line. The plane affects the path that the club head follows during the swing. Ideally, the golf club's path is on a single plane, to maintain consistency. If the club swings on more than one plane, it is difficult to be consistent. A majority of golfers from beginners to amateurs alike fail to position the golf club properly in the downswing. Thus, mastering the downswing is, by far, the most challenging aspect of the golf swing for a majority of golfers. Accordingly, it is also desirable to have a golf swing training aid which assists a golfer in positioning the golf club properly in the downswing and within the same downswing plane.

There are a number of golf training aids that are designed to help improve various aspects of a golfer's golf swing. For example, U.S. Published Patent Application No. 2015/0375080 to Boisvert, discloses a golf swing trainer for assisting a golfer to achieve a tour impact position during execution of a golf swing and focuses on the shaft position of the golf club when the club head impacts the golf ball. However, Boisvert is disadvantageous in that the trainer is received over the butt end of a golf club, thus covering a portion of the golf club grip where the golfer's hands would normally sit when gripping the golf club. Accordingly, the position of the trainer interferes with the golfer's normal grip on the golf club without the trainer, and, as a result, the golfer is forced to "choke down" on his/her grip of the golf club, making the club shorter than it would be with the golfer's normal grip, rendering Boisvert less effective as a training aid. Furthermore, the manners of attachment of the trainer to the golf club in Boisvert are ineffective at properly securing the trainer to the golf club during the golf swing as the force generated by a normal golf swing would cause the trainer to disconnect from the golf club.

Another golf training device is set forth in U.S. Pat. No. 7,789,765 to Marini which discloses a golf training aid having a telescoping rod mounted over the butt end of a golf club and focuses on the shaft position of the golf club when impacting the golf ball. The telescoping rod is manually fixed in an extended or shortened position to assist a golfer in improving his/her chipping motion. However, the mounting of Marini over the butt end and a portion of the sides of the golf club grip interferes with a golfer's normal grip on the club and does not allow the golfer to take a standard address position when the aid is extended.

U.S. Published Patent Application No. 2004/0048679 to Bunting discloses an alignment device for a golf club which focuses on placing the displaceable elongate member of the golf club against the leading side of the person, thus training the person to optimally impact the golf ball. Starting a golf swing in this position is not the standard address position that one would begin from. Bunting sets forth a manually telescoping member mounted via a clamping device received over the butt end and a portion of the sides of the golf club grip, thus interfering with a golfer's grip on the golf club.

Therefore, while there are many known devices and equipment to aid a golfer in improving his/her swing, they are largely focused on the position of the golf club shaft when impacting the golf ball and are not focused on the downswing. Furthermore, these devices are unsatisfactory for, among others, the reasons set forth above. As a result, it is desirable to provide a golf training aid that assists a golfer in improving the technical aspects of his/her golf swing by both establishing and maintaining lag in the downswing along with maintaining the proper downswing plane, to instill consistent, solid contact with the golf ball and, thus a desirable ball flight.

SUMMARY OF THE INVENTION

It is therefore an object of the present invention to provide a novel golf training aid for improving a golfer's golf swing and a method of use thereof.

It is another object of the present invention to provide a golf training aid that is insertable into the grip end of a shaft of a golf club and does not interfere with the golfer's grip of the golf club.

It is also an object of the present invention to provide a golf training aid which allows an individual to both feel and see how to hit a golf ball more effectively.

In addition, it is an object of the present invention to provide a golf training aid that is removably insertable into the golf club.

It is also an object of the present invention to provide a golf training aid which trains a golfer to be positioned properly on the downswing.

It is yet another object of the present invention to provide a golf training aid that assists a golfer in establishing and maintaining lag in his/her golf swing along with maintaining the proper downswing plane.

Certain of the foregoing and related objects are readily attained according to the present invention through the provision a golf training aid for improving a golfer's golf swing, insertable into a grip end of a shaft of a golf club, comprising an elongate rod having a first end and an opposite second end; means for slidably connecting said rod to the grip end of the shaft of the golf club, with said first end and at least a portion of said rod being received within the hollow shaft of the golf club and with said second end of said rod disposed outwardly beyond the grip end of the shaft of the golf club; and a training element connected to said second end of said rod, said training element being of a sufficient dimension and configuration to effect sliding movement of said rod when under the influence of gravity when the golf club is swung; whereby said rod is slidably moveable from a retracted position to an extended position during a golf swing via gravity acting on said rod and said training element, wherein when the golf club is positioned at address relative to a golf ball, said rod is in said retracted position whereby said training element is disposed generally adjacent to the grip end of the shaft of the golf club and a predetermined portion of said rod is received within the shaft of the golf club, and wherein when the golf club is moved into a backswing, said rod slidably moves from said retracted position into said extended position via gravity acting on said rod and said training element, whereby said predetermined portion of said rod is extended outwardly beyond the grip end of the shaft of the golf club and said training element is spaced apart from the grip end of the shaft of the golf club, and wherein when the golf club is moved into a downswing, said rod and said training element maintain said extended position and said training element is swung past the golfer's lead leg on the downswing, so that the hands of the golfer are aligned with the trail leg of the golfer when the shaft of the golf club is parallel to the ground, before the golf club makes contact with the golf ball, if the golf swing is properly performed.

In the preferred embodiment, said rod and said training element are aligned with and slidably move along a generally centrally disposed longitudinally extending axis of the shaft of the golf club. Advantageously, said training element is a member selected from the group consisting of generally cylindrical-shaped and generally spherical-shaped. Desirably, said rod is removably insertable into the grip end of the shaft of the golf club.

It is also desirable that the training aid further comprises a hollow, tubular sleeve connectable to the grip end of the shaft of the golf club, and a portion of which is received within the hollow shaft of the golf club, wherein said rod is slidably received within said sleeve. Additionally, it is advantageous that the training aid further comprises a flute connected to said sleeve and disposed outwardly from and adjacent to the grip end of the shaft of the golf club, wherein said training element is seated within said flute in said retracted position and said training element is spaced apart from said flute in said extended position. Preferably, said flute comprises an outer concave first surface, an opposite convex second surface, and defines an opening generally in the center thereof in which said rod is slidably received.

It is advantageous that said sleeve has a first angled end and said first end of said rod has a tapered tip, to ease insertion of said rod and said sleeve into the grip end of the shaft of the golf club. In the preferred embodiment, said means for slidably connecting said rod to the grip end of the shaft of the golf club comprises said tip and said sleeve, wherein said tip has a diameter which is greater than a diameter of said sleeve. It is also preferred that said sleeve has an outwardly extending barb formed thereon, to secure said sleeve to the grip end of the shaft of the golf club.

Desirably, said rod moves from said retracted position into said extended position with ease on the backswing. Preferably, in said extended position, said training element is disposed in the range of approximately 12-14" from the grip end of the shaft of the golf club and in said retracted position, said training element is disposed in the range of approximately 2-3" from the grip end of the shaft of the golf club.

Certain of the foregoing and related objects are readily attained according to the present invention through the provision of a golf training aid assembly for improving a golfer's golf swing, comprising a golf club having a shaft with a first end with a club head and an opposite second grip end with a club grip; and a golf training aid for improving a golfer's golf swing, inserted into said grip end of said shaft of said golf club, comprising an elongate rod having a first end and an opposite second end; means for slidably connecting said rod to said grip end of said shaft of said golf club, with said first end and at least a portion of said rod being received within said hollow shaft of said golf club and with said second end of said rod disposed outwardly beyond said grip end of said shaft of said golf club; and a training element connected to said second end of said rod, said training element being of a sufficient dimension and configuration to effect sliding movement of said rod when under the influence of gravity when said golf club is swung; whereby said rod is slidably moveable from a retracted position to an extended position during a golf swing via gravity acting on said rod and said training element, wherein when said golf club is positioned at address relative to a golf ball, said rod is in said retracted position whereby said training element is disposed generally adjacent to said grip end of said shaft of said golf club and a predetermined portion of said rod is received within said shaft of said golf club, and wherein when said golf club is moved into a backswing, said rod slidably moves from said retracted position into said extended position via gravity acting on said rod and said training element, whereby said predetermined portion of said rod is extended outwardly beyond said grip end of said shaft of said golf club and said training element is spaced apart from said grip end of said shaft of said golf club, and wherein when said golf club is moved into a downswing, said rod and said training element maintain said extended position and said training element is swung past the golfer's lead leg on the downswing, so that the hands of the golfer are aligned with the trail leg of the golfer when the shaft of the golf club is parallel to the ground, before the golf club makes contact with the golf ball, if the golf swing is properly performed.

In the preferred embodiment, said rod is removably insertable into said grip end of said shaft of said golf club. It is also preferred that the assembly further comprises a hollow, tubular sleeve connectable to said grip end of said shaft of said golf club, and a portion of which is received within said hollow shaft of said golf club, wherein said rod is slidably received within said sleeve. Advantageously, said club grip has a closed end defining an opening therein on said grip end of said shaft of said golf club, and wherein said sleeve and said rod are received within said opening. Desirably, said sleeve has a first angled end and said first end of said rod has a tapered tip, to ease insertion of said rod and said sleeve into said opening defined in said grip end of said shaft of said golf club.

Additionally, certain of the foregoing and related objects are readily attained according to the present invention through the provision of a method of training for golf, comprising the steps of providing a golf club having a shaft with a first end with a club head and an opposite second grip end with a club grip; providing a golf training aid for improving a golfer's golf swing, inserted into said grip end of said shaft of said golf club, comprising an elongate rod having a first end and an opposite second end; means for slidably connecting said rod to said grip end of said shaft of said golf club, with said first end and at least a portion of said rod being received within said hollow shaft of said golf club and with said second end of said rod disposed outwardly beyond said grip end of said shaft of said golf club; and a training element connected to said second end of said rod, said training element being of a sufficient dimension and configuration to effect sliding movement of said rod when under the influence of gravity when said golf club is swung, whereby said rod is slidably moveable from a retracted position to an extended position during a golf swing via gravity acting on said rod and said training element; positioning said golf club at address relative to a golf ball, whereby said rod is in said retracted position with said training element disposed generally adjacent to said grip end of said shaft of said golf club and a predetermined portion of said rod being received within said shaft of said golf club; moving said golf club into a backswing, whereby said rod slidably moves from said retracted position into said extended position via gravity acting on said rod and said training element, with said predetermined portion of said rod being extended outwardly beyond said grip end of said shaft of said golf club and said training element being spaced apart from said grip end of said shaft of said golf club; and moving said golf club into a downswing, whereby said rod and said training element maintain said extended position and said training element is swung past the golfer's lead leg on the downswing, so that the hands of the golfer are aligned with the trail leg of the golfer when the shaft of the golf club is parallel to the ground, before the golf club makes contact with the golf ball, if the golf swing is properly performed. In the preferred embodiment, the method further comprises providing a hollow, tubular sleeve connectable to said grip end of said shaft of said golf club, and said club grip has a closed end defining an opening therein on said grip end of said shaft of said golf club, and said method further comprises the step of inserting said sleeve and said first end of said rod into said opening.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED EMBODIMENTS

Figure 1:
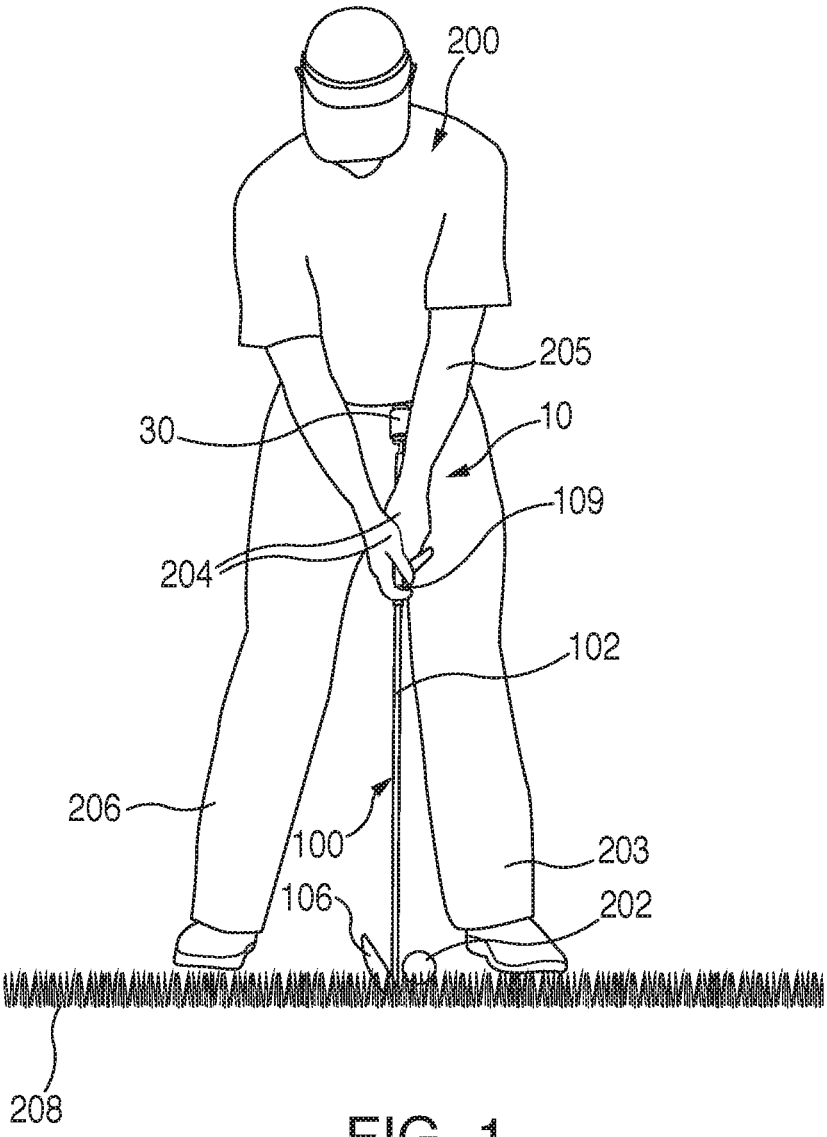
FIG. 1 is a view of a golfer positioned at address with a golf club having the golf training aid, according to a first embodiment of the present invention, inserted therein, with the rod and training element being in the retracted position.

Turning now in detail to the drawings and particularly FIG. 1, which illustrates the golf training aid, generally designated by reference numeral 10, according to a first embodiment of the present invention, being utilized by a golfer 200 in training to improve the golfer's golf swing. As seen in FIG. 1, training aid 10 is connectable to a conventional golf club 100. In the preferred embodiment, training aid 10 is universally adaptable and is configured and dimensioned to be selectively and releasably insertable into any conventional golf club 100, except for a putter. However, it can be appreciated that training aid 10 may be permanently connected to a golf club 100 to serve as a dedicated training device. As shown best in FIGS. 1 and 4, a conventional golf club 100 has a hollow shaft 102 with a first end 104 having a club head 106 for striking a golf ball 202 and an opposite second butt end or grip end 108 having a club grip 109, which is grasped by golfer 200. Typically, club grip 109 covers grip end 108 and a portion of the sides of shaft 102 adjacent to grip end 108. As seen best in FIGS. 2-3, club grip 109 also defines an opening 110 generally centrally on grip end 108 which is approximately ⅛" in diameter.

As seen best in FIGS. 2-3 and 8-9, golf training aid 10, according to the present invention, is connected to golf club 100 by inserting training aid 10 into opening 110 in club grip 109 of golf club 100. Preferably, training aid 10 is removably inserted into grip end 108 of shaft 102 of golf club 100, so that golfer 200 can utilize his/her own golf club 100 with the attached training aid 10, as desired, for training purposes and training aid 10 can be removed from golf club 100, when playing a round of golf. The removability of training aid 10 from golf club 100 is advantageous in that it allows a golfer 200 to train utilizing his/her own golf clubs 100 rather than a separate training device that would not be used when playing a round of golf. Training aid 10 is also connected to golf club 100 in such a manner that it does not interfere with the golfer's normal grip of club grip 109. In other words, since training aid 10 is insertable into grip end 108 of golf club 100 and does not overlie the sides of club grip 109 overlying shaft 102, a golfer can grasp the golf club 100 in a normal manner as he/she would if training aid 10 were not attached to golf club 100. Therefore, training aid 10 does not interfere with the golfer's normal grip of club grip 109 of golf club 100, making it an effective training aid.

As also seen in FIGS. 2-3 and 8-9, training aid 10 comprises an elongate rod 20 having a first end 22 and an opposite second end 24. Rod 20 is slidably connected to grip end 108 of shaft 102 of golf club 100 by being inserted into opening 110 of club grip 109. Rod 20 remains connected to grip end 108 during the golf swing via means for slidably connecting rod 20 to grip end 108 of golf club 100 and particularly due to the dimension of tip 26 on end 22 of rod 20 relative to sleeves 40 and 60, as discussed more fully below. As best illustrated in FIGS. 2-3 and 8-9, once training aid 10 is inserted into opening 110 of club grip 109 of golf club 100, first end 22 and at least a portion of rod 20 are received within the hollow shaft 102 of golf club 100. As also seen in FIGS. 2-3 and 8-9, second end 24 of rod 20 remains exposed and is disposed outwardly beyond grip end 108 of golf club 100. In the preferred embodiment, rod 20 is made of a fiberglass material, however, it can be appreciated that other materials may be suitable for use in connection with the present invention and would be known by those having ordinary skill in the art. Furthermore, in the preferred embodiment, rod 20 is approximately 19" in length, so that in the extended position discussed below, rod 20 is sufficiently long to permit training element 30 to be swung past the golfer's lead leg 203 on the downswing, as described more fully below.

Figure 7A:
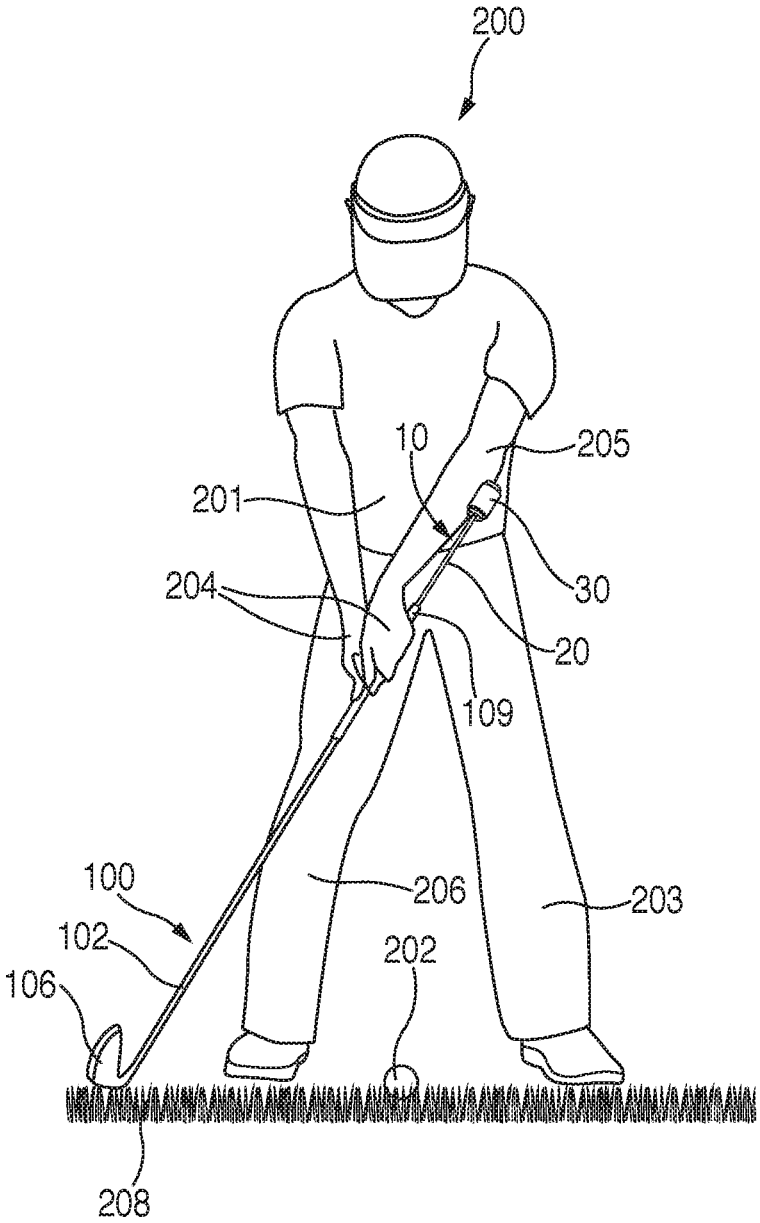
FIG. 7*a* illustrates a golfer having an improper swing and failing to swing the training element past the golfer's lead leg on the downswing.
Figure 7B:
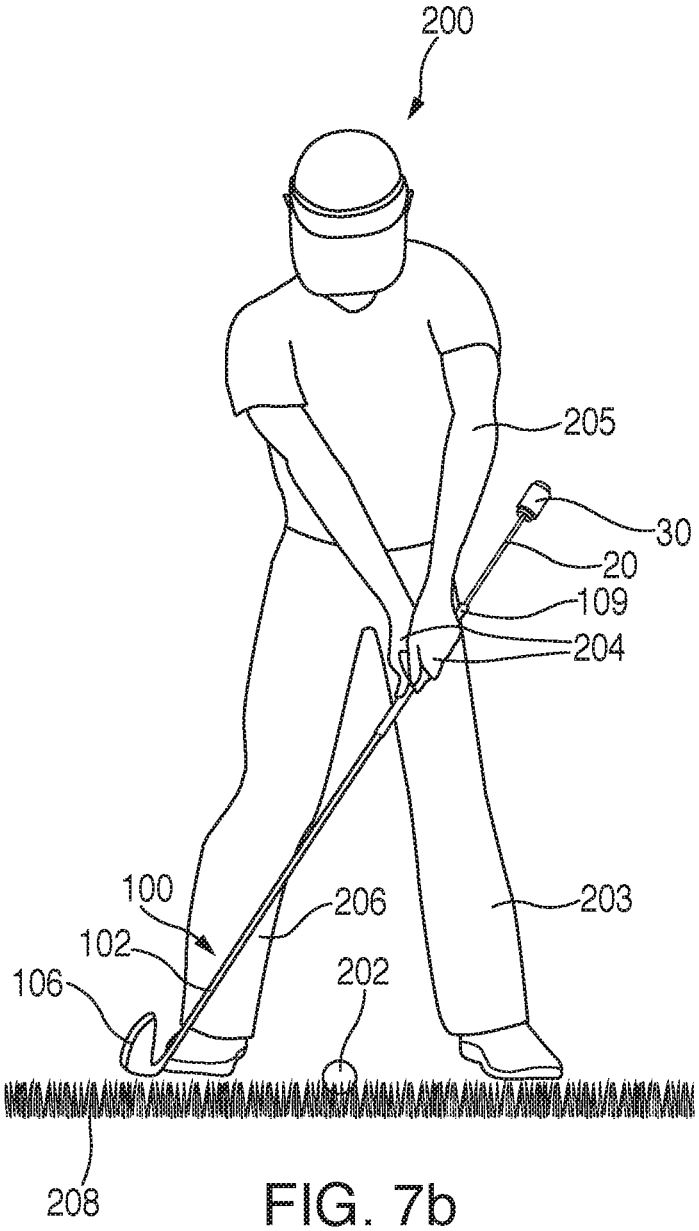
FIG. 7*b* is a view similar to FIG. 7*a*, but with the golfer having a proper swing and effectively swinging the training element past the golfer's lead leg on the downswing.
Figure 8:
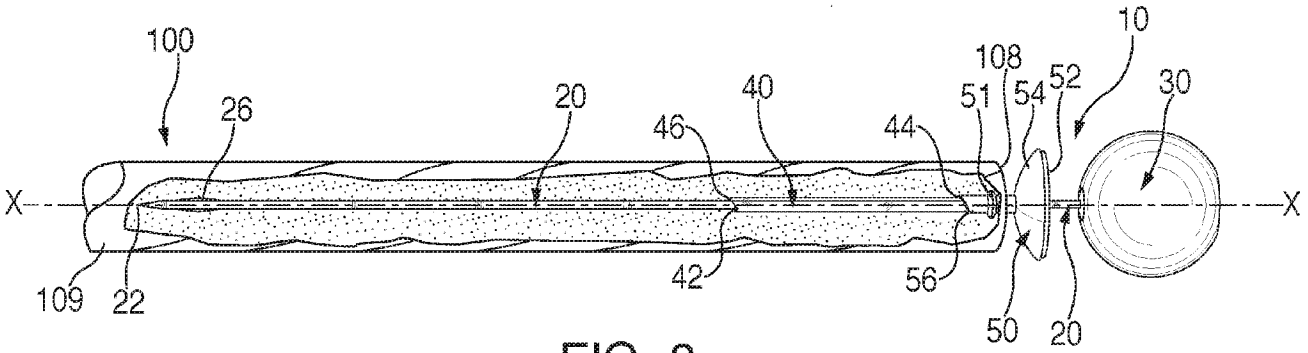
FIG. 8 is a side elevation view of a second embodiment of the golf training aid according to the present invention, in the retracted position, inserted into the grip end of a golf club illustrated in section.
Figure 9:
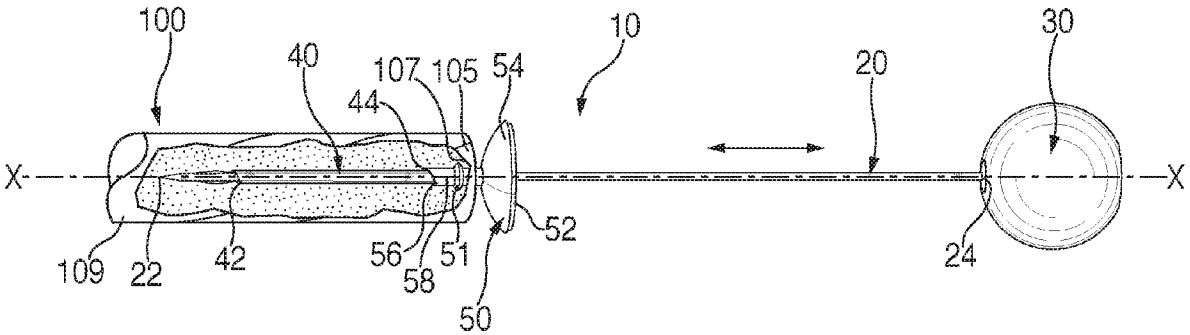
FIG. 9 is a side elevation view similar to FIG. 8, but with the training aid being in the extended position.

As seen best in FIGS. 2-3 and 8-9, a training element 30 is connected to second end 24 of rod 20. In the preferred embodiment as seen in FIGS. 1-7, training element 30 is generally cylindrical shaped having a flat upper surface 32 and an opposite flat lower surface 34. Preferably, cylindrical training element 30 has a diameter of approximately 1½" and a height in the range of approximately 1½-2". Alternatively, as seen in FIGS. 8-9, training element 30 is generally spherically-shaped having a diameter of approximately 3 inches or less. It is also preferable that training element 30 is brightly colored so that it is easily visible to golfer 200 while swinging golf club 100. In the preferred embodiment, training element 30 is made of a soft, compressible material, such as foam, so that it will not injure the golfer 200, if contacted by it. However, it can be appreciated that training element 30 may be other shapes, dimensions, materials, and colors.

Training element 30 is of a sufficient weight, dimension, and configuration to effect sliding movement of rod 20 when under the influence of gravity when golf club 100 is swung by golfer 200. In the preferred embodiment, rod 20 slides out of shaft 102 with ease and, therefore, moves from the retracted position (FIGS. 2 and 8) into the extended position (FIGS. 3 and 9) with ease on the backswing, due to the weight of training element 30 and the clearance between rod 20 and sleeve 40 or 60. For example, in a preferred embodiment of the present invention, training element 30 is approximately 10 grams, rod 20 has a diameter of ⅛", and sleeves 40 and 60 have a diameter of 3⁄16". However, it can be appreciated that the training element 30 may be other weights and rod 20 and sleeves 40 and 60 may have other diameters, so long as rod 20 moves from the retracted position (FIGS. 2 and 8) into the extended position (FIGS. 3 and 9) and, preferably, with ease, when golf club 100 is moved into the backswing.

Figure 2:
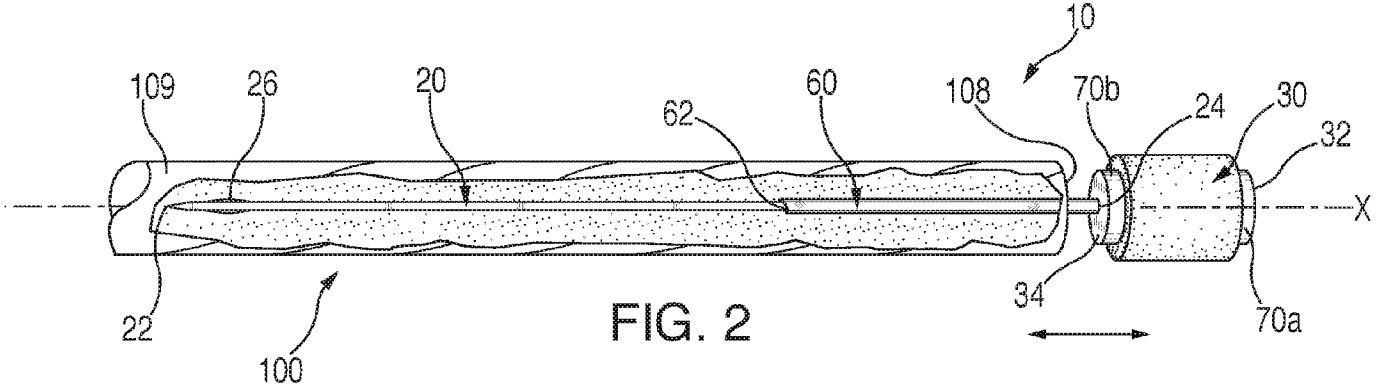
FIG. 2 is a side elevation view of the golf training aid according to a first embodiment of the present invention, in the retracted position, inserted into the grip end of a golf club illustrated in section.
Figure 3:
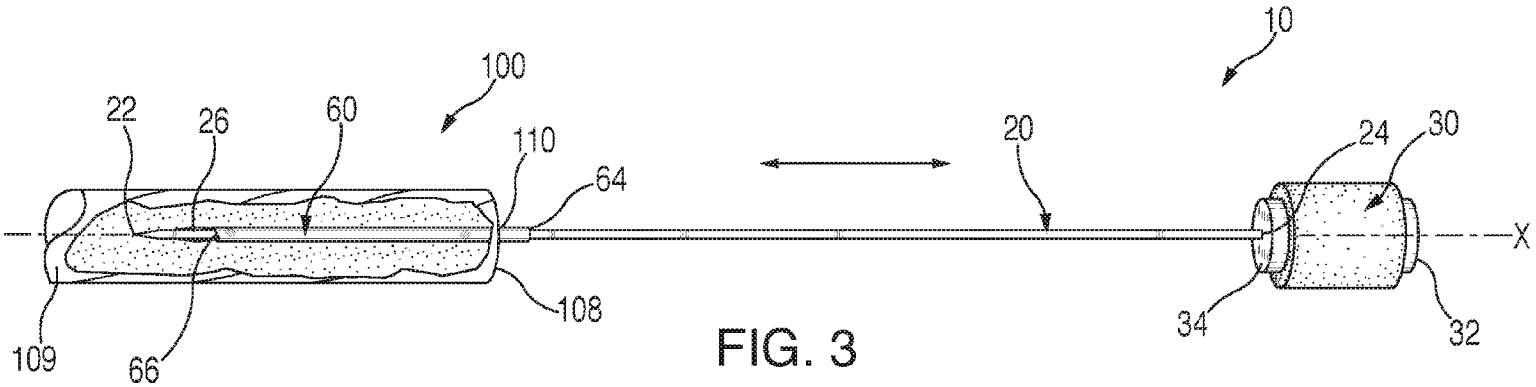
FIG. 3 is a side elevation view similar to FIG. 2, but with the golf training aid being in the extended position.

In use, rod 20 is slidably moveable within sleeves 40 and 60 disposed within opening 110 of club grip 109, from a retracted position, as seen in FIGS. 2 and 8 to an extended position, as seen in FIGS. 3 and 9, during a golf swing via gravity acting on 20 rod and training element 30. Particularly, the force of gravity acting on training element 30 causes rod 20 to slide from the retracted position to the extended position. As seen best in FIGS. 2-3 and 8-9, golf club 100 has a generally centrally disposed and longitudinally extending axis x and rod 20 and training element 30 are aligned with and slidably move along axis x of shaft 102 of golf club 100.

In the embodiment of the present invention seen in FIGS. 2-3, to allow slidable movement within opening 110 training aid 10 further comprises a hollow, tubular sleeve 60 slidably received over rod 20, in order to slidably connect rod 20 to club grip 109 of golf club 100. Preferably, sleeve 60 has a length of approximately 5" and a diameter of approximately 3⁄16". However, it can be appreciated that the dimensions may vary. As seen in FIGS. 2-3, sleeve 60 has a first end 62, an opposite second end 64, and defines a channel 66 therebetween. Rod 20 is slidably received within channel 66 of sleeve 60.

In use, first end 62 of sleeve 60 is inserted into opening 110 of club grip 109 together with end 22 of rod 20, such that first end 62 and a portion of sleeve 60 as well as end 22 and a portion of rod 20 are received within shaft 102. Sleeve 60 and rod 20 are manually pressed into opening 110 and into shaft 102, so that second end 64 of sleeve 60 and end 24 of rod 20 remains disposed outwardly from grip end 108. Preferably, approximately ¼"-½" of sleeve 60 is disposed outwardly from grip end 108, when training aid 10 is connected to golf club 100. Sleeve 60 is inserted into and retained within opening 110 with a friction fit and the diameter of sleeve 60 is sufficient so that sleeve 60 is retained within opening 110 during a golf swing.

In the preferred embodiment, cylindrical training element 30 has caps **70*a* and 70*b* overlying each of ends 32 and 34, respectively. Cap 70*a* overlies end 32 and aids in securing rod 20 to training element 30 and cap 70*b* overlies end 34 and aids in manually inserting sleeve 60 into opening 110 of club grip 109. Particularly, to insert sleeve 60 into opening 110, golfer 200 applies manual pressure against training element 30, so that lower surface 34 of training element 30 contacts end 64 of sleeve 60 to press sleeve 60 into opening 110. Preferably, end 62 of sleeve 60 is angled to ease insertion of sleeve 60 into opening 110. Additionally, a stopper tip 26 on first end 22 of rod 20 is tapered to also aid in insertion of rod 20 into opening 110 (see, FIGS. 2-3 and 8-9). In order to secure rod 20 to sleeve 60 and prevent rod 20 and, in turn, training aid 10 from dislodging from golf club 100 when swung, the diameter of tip 26 of rod 20 is greater than the inner diameter of sleeve 60**.

In the first embodiment of the present invention, when training aid 10 is in the retracted position as seen in FIG. 2, training element 30 is disposed on top of sleeve 60 with end 34 of training element 30 overlying and abutting end 64 of sleeve 60. In the extended position as seen in FIG. 3, end 34 of training element 30 is spaced apart from end 64 of sleeve 60 and, thus, from grip end 108 of golf club 100.

In a second embodiment of the present invention, as seen in FIGS. 8-9, training aid 10 further comprises a hollow, tubular sleeve 40 connected to a flute or training aid holder 50, collectively in which rod 20 is slidably received. Preferably, sleeve 40 and flute 50 are an integral one-piece component. Sleeve 40 and flute 50 are connected to golf club 100 to secure training aid 10 in place during a golf swing and flute 50 serves as a holder for training element 30 and also aids golfer 200 to apply leverage to manually insert and remove sleeve 40 from golf club 100. As seen in FIGS. 8-9, sleeve 40 has a first end 42, an opposite second end 44, and defines a channel 46 extending therebetween. In the preferred embodiment, sleeve 40 is 5" in length and has a diameter of 3/16". However, the dimensions may vary.

As seen in FIGS. 8-9, flute 50 is generally cup-shaped having an outer concave first surface 52 and an opposite inner convex second surface 54. Training element 30 is seated within concave first surface 52 of flute 50 when in the retracted position, as seen in FIG. 8, and training element 30 is spaced apart from flute 50 in the extended position in FIG. 9. Flute 50 also includes a hollow, tubular stem 58 connected to and extending outwardly from second surface 54. Stem 58 and flute 50 collectively define a channel 56 generally in the center thereof.

As illustrated in FIGS. 8-9, flute 50 and sleeve 40 are connected together in such a manner that channel 46 of sleeve 40 is aligned with channel 56 in flute 50, along axis x. As illustrated best in FIGS. 8-9, rod 20 is collectively received within channel 46 of sleeve 40 and channel 56 in flute 50, to allow rod 20 to slidably move from the retracted position in FIG. 8 to the extended position in FIG. 9, relative to grip end 108 of golf club 100.

As also seen in FIGS. 8-9, training aid 10 and, therefore, sleeve 40 and flute 50 are removably connectable to grip end 108 of golf club 100, by insertion into opening 110. As seen in FIGS. 8-9, in the second embodiment of the present invention, end 22 of rod 20 and first end 42 of sleeve 40 are inserted into opening 110, to connect training aid 10 to golf club 100. Particularly, rod 20 and first end 42 of sleeve 40 are manually inserted into opening 110, until second surface 54 of flute 50 is abutting and overlying outer surface 105 of grip end 108. To ease insertion of training aid 10 into opening 110 in club grip 109, first end 42 of sleeve 40 is angled. Once inserted, sleeve 40 and at least a portion of stem 58 are received within the hollow shaft 102 of the golf club 100. An upper portion of stem 58 and flute 50 are disposed outwardly beyond grip end 108 of golf club 100.

As seen in FIGS. 8-9, to secure training aid 10, according to a second embodiment of the invention, in place on golf club 100, stem 58 of flute 50 has an outwardly extending barb 51 formed thereon. In the preferred embodiment, barb 51 is disposed 1" from surface 54 of flute 50. However, it can be appreciated that the distance of barb 51 from surface 54 of flute 50 can vary. Training aid 10 is inserted into club grip 109 of golf club 100 to a sufficient extend such that barb 51 is received within shaft 102 of golf club 100 and is abutting the inner surface 107 of the club grip 109. Barb 51 has a diameter that allows it to be easily manually and removably inserted into and through opening 110 of club grip 109 but which is sufficiently large to effectively secure training aid 10 to golf club 100 during a golf swing, and prevent training aid 10 from being dislodged from golf club 100 when swung. In the preferred embodiment, the diameter of barb 51 is ¼". However, it can be appreciated that the dimensions of barb 51 may vary. Furthermore, in order to secure rod 20 to sleeve 40, the diameter of tip 26 is greater than the inner diameter of sleeve 40.

As a result, in both the first embodiment of the invention illustrated in FIGS. 1-7 and the second embodiment of the invention illustrated in FIGS. 8-9, rod 20 and, in turn, training element 30 are collectively slidably movable from a retracted position to an extended position. In the retracted position, such as shown in FIGS. 2 and 8, training element 30 is disposed 2-3" from grip end 108 of golf club 100. In the extended position, such as shown in FIGS. 3 and 9, training element 30 is preferably disposed outwardly approximately 12-14" from grip end 108 of the shaft 102 of golf club 100. Such length is preferable to permit an adult golfer 200 to swing training element 30 past the golfer's lead leg 203, as shown in FIGS. **6*b* and 7*b*, if the swing is performed properly. However, it can be appreciated that the dimensions may vary and may be other dimensions depending on the size of the player or if training aid 10** is utilized by a child.

In use, when a golfer desires to utilize training aid 10, training aid 10 is inserted into the opening 110 formed in club grip 109 on grip end 108 of shaft 102 of golf club 100. As seen in FIG. 1, when the golfer 200 positions golf club 100 at the initial address position relative to a golf ball 202, rod 20 is disposed in the retracted position (see also, FIGS. 2 and 8). In the retracted position, training element 30 is disposed generally adjacent to grip end 108 of golf club 100. Particularly, in the embodiment in FIGS. 2-3 training element 30 is resting atop end 64 of sleeve 60. In the embodiment in FIGS. 8-9, training element 30 seated within concave surface 52 of flute 50. As a result, a predetermined portion of rod 20 is received within shaft 102 of golf club 100.

Figure 4:
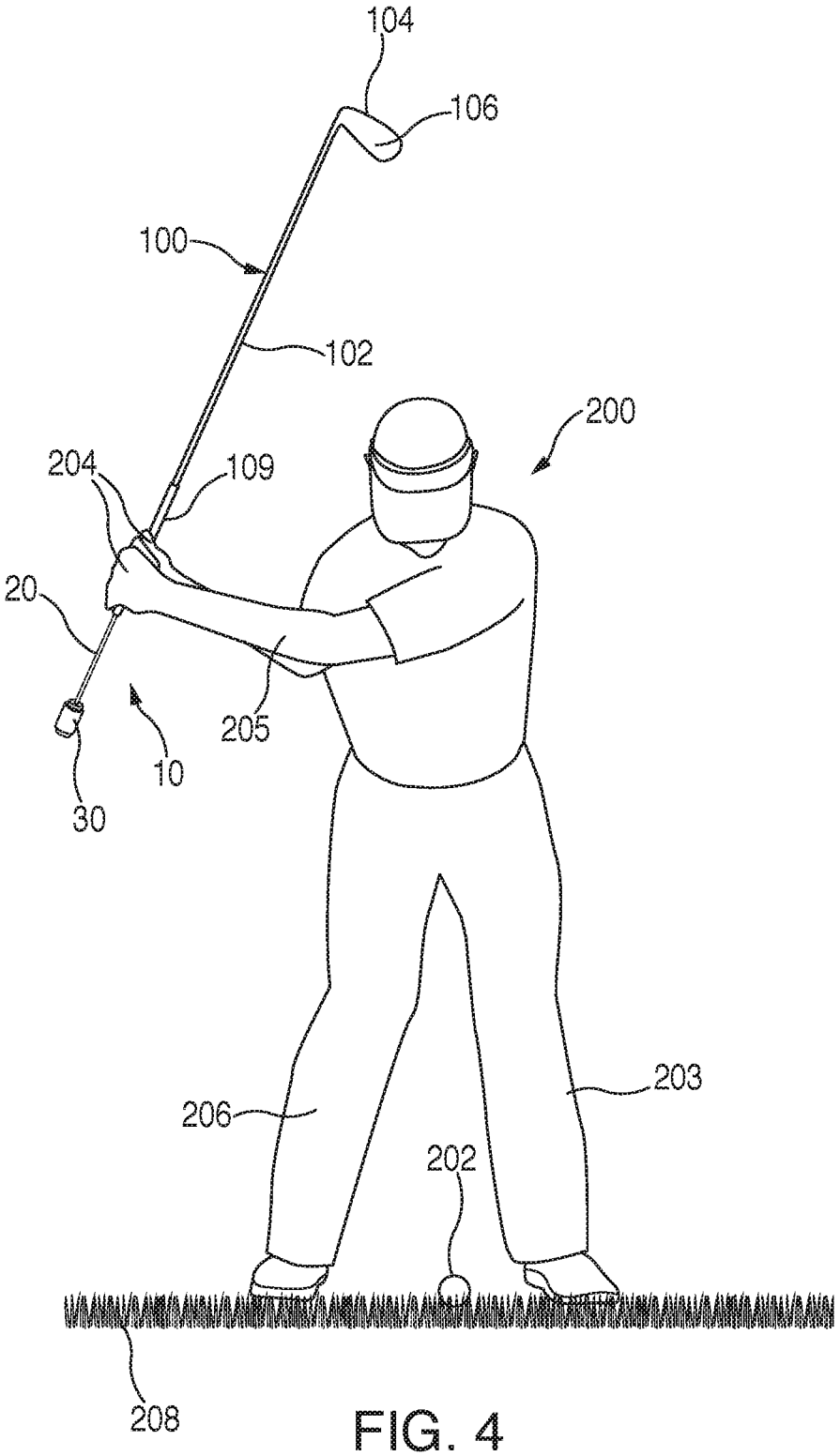
FIG. 4 illustrates a golfer with the golf club positioned in the backswing, with the golf training aid of FIGS. 2-3 moved into the extended position.

As seen in FIG. 4, when golfer 200 swings golf club 100 into the backswing, the force of gravity causes rod 20 and, in turn, training element 30 to slidably move from the retracted position (FIGS. 2 and 8) into the extended position (FIGS. 3 and 9). As a result, the predetermined portion of rod 20 is extended from inside shaft 102 outwardly beyond grip end 108 of golf club 100 and training element 30 is unseated from surface 52 of flute 50 (FIG. 8) or from sleeve 60 (FIG. 3) and is moved to a position which is spaced apart from grip end 108 of golf club 100. As mentioned above, in the preferred embodiment, when in the extended position, training element 30 is disposed 12-14" from grip end 108 of the shaft 102 of golf club 100. However, it can be appreciated that the distance between training element 30 from grip end 108 may vary depending on the size of the golfer 200, such as if the training aid 10 is utilized by a child. It can further be appreciated that the training aid 10 may be adjustable to allow the golfer 200 to customize the length that rod 20 extends from grip end 108 of golf club 100.

Figure 5A:
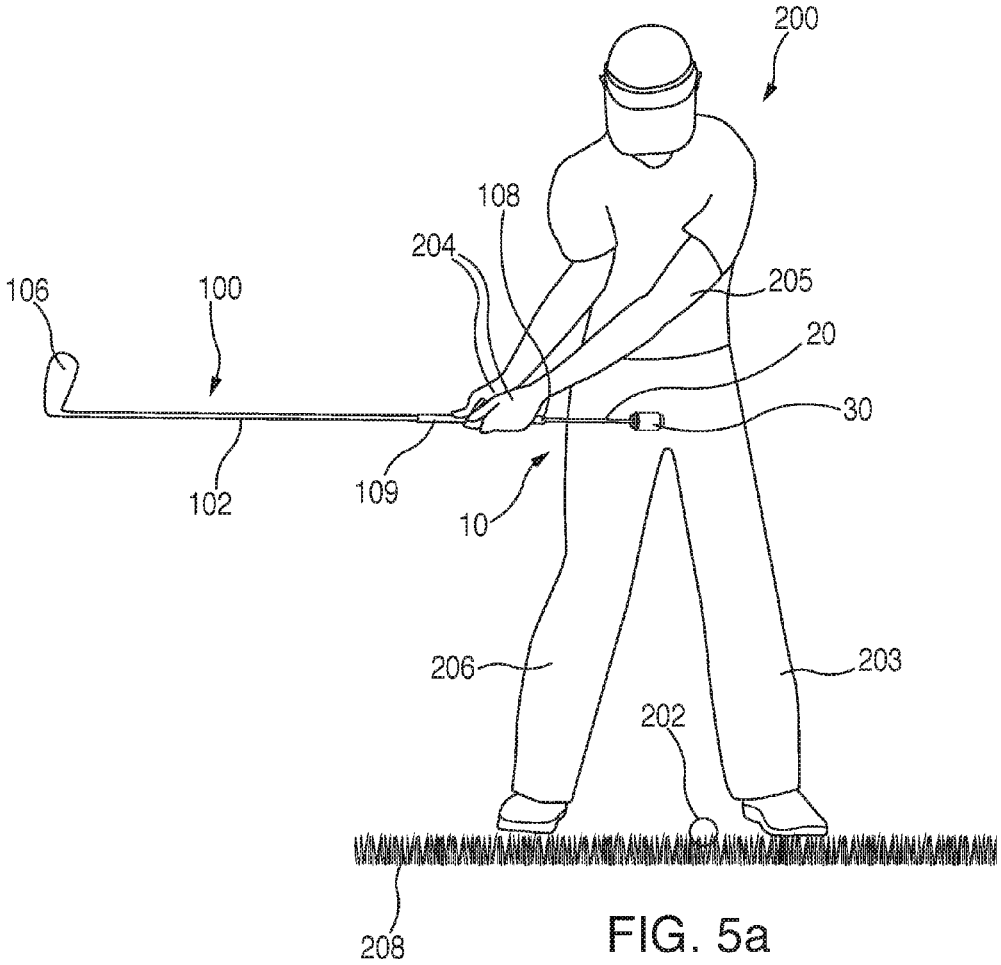
FIG. 5*a* illustrates a golfer using the golf training aid of FIGS. 2-3, having an improper swing with the golfer's hands being located behind the golfer's trail leg, when the golf club is parallel to the ground.
Figure 5B:
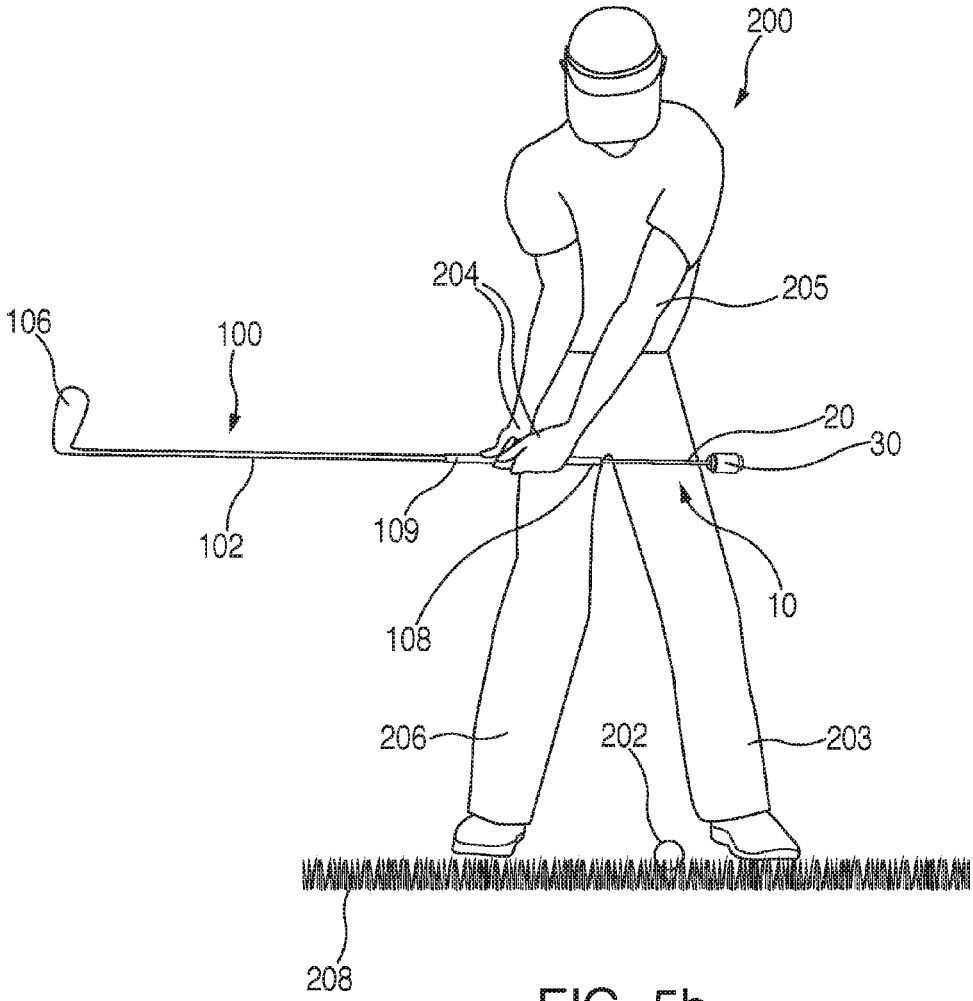
FIG. 5*b* is a view similar to FIG. 5*a*, but illustrates a golfer having a proper swing with the golfer's hands being aligned with the trail leg, when the golf club is parallel to the ground.
Figure 6A:
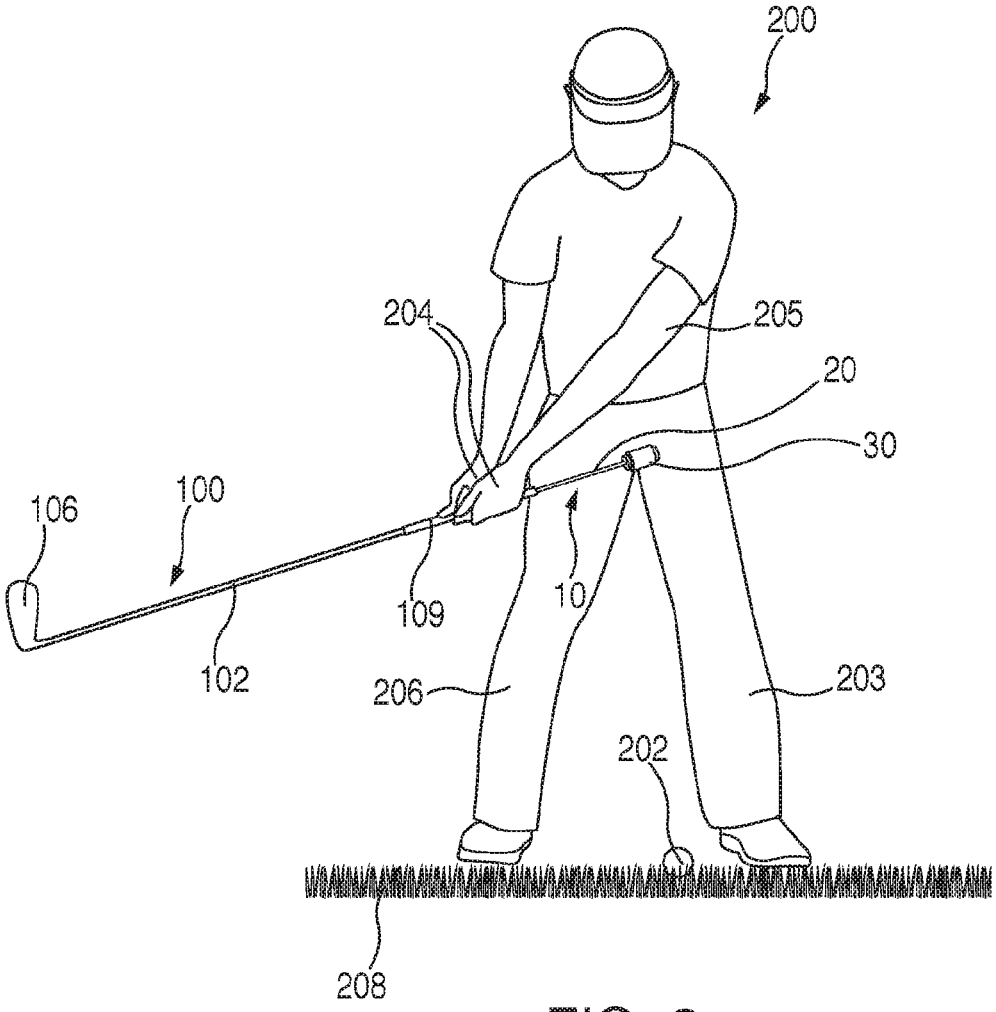
FIG. 6*a* illustrates a golfer having an improper swing and failing to swing the training element past the golfer's lead leg on the downswing.
Figure 6B:
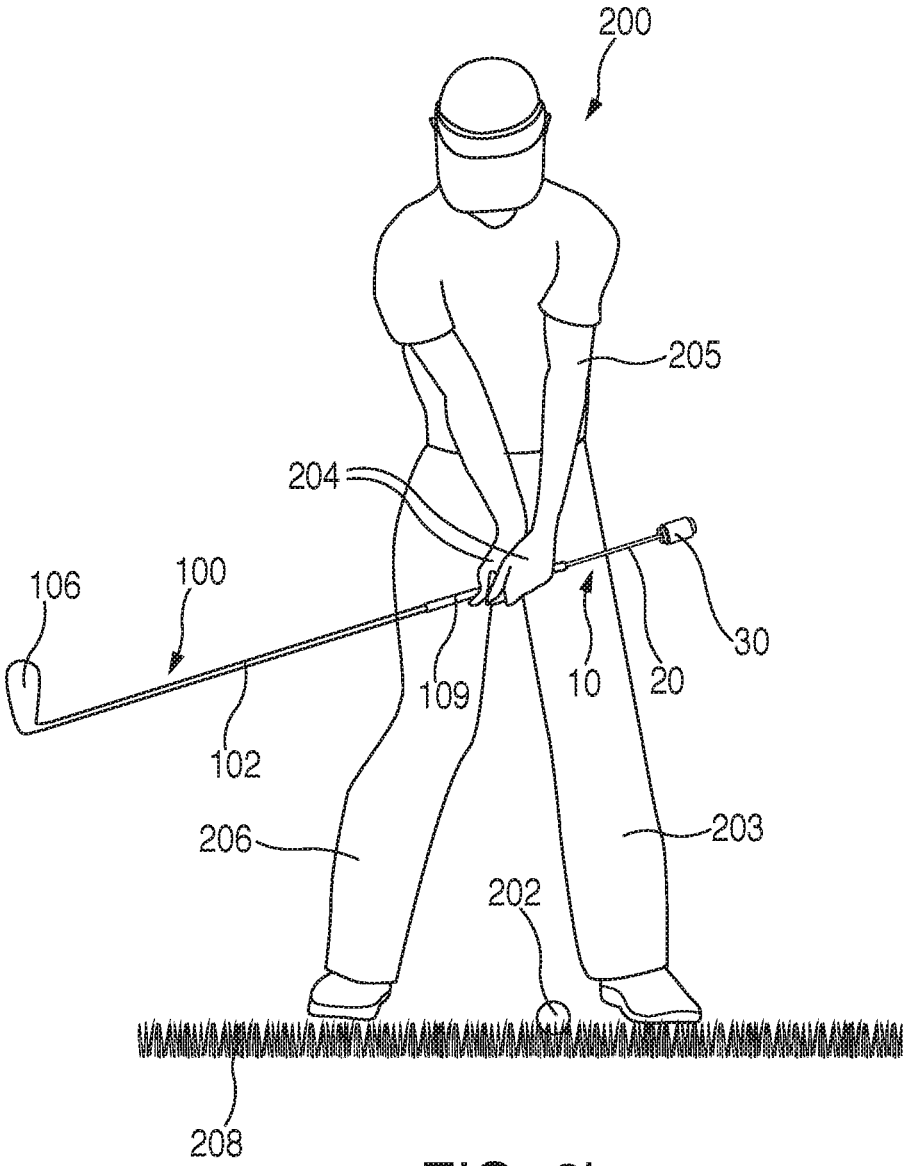
FIG. 6*b* is a view similar to FIG. 6*a*, but with the golfer having a proper swing and effectively swinging the training element past the golfer's lead leg on the downswing.

Furthermore, as the golfer 200 continues the golf swing and the golf club 100 is moved into the downswing in FIGS. 5-7, rod 20 and training element 30 are maintained in the extended position, due to centrifugal force. It is the aim of the golfer 200 using the training aid 10, to swing training element 30 past the golfer's lead leg 203 on the downswing, as seen in FIGS. **5*a*, 6*a*, and 7*a* which trains the golfer 200 to maintain a 90° angle between the golfer's lead 205 arm and the golf club 100. Accordingly, the golfer 200 uses training element 30 as a visual aid in use, to take the focus off of the impact between club head 106 and golf ball 202, and instead, allows the golfer to apply a proper technique by focusing on the position of the training element 30 during the downswing. If the golf swing is performed properly such as in FIG. 5***a*, the hands 204 of the golfer 200, are aligned with the trail leg 206 of the golfer 200 when the shaft 102 of the golf club 100 is parallel to the ground 208, before the golf club 100 makes contact with the golf ball 202. As a result, if the golf swing is properly performed, such as in FIGS. 5*a*, 6*a* and 7*a*, the golfer is positioned in a more ideal position to strike the golf ball 202 more effectively.

If the golf swing is improperly performed, such as that shown in FIGS. 5*b*, 6*b*, and 7*b*, the training element 30 contacts the golfer 200 in midsection 201, thus providing instant feedback that an improper technique was performed on the golf swing. When a golfer has completed his/her training utilizing training aid 10, training aid 10 is easily manually removed from the grip end 108 of shaft 102 of golf club 100.

Accordingly, the training aid 10 according to the present invention aids a golfer 200 in improving multiple aspects of the golfer's swing. Particularly, as seen in FIGS. 5*a*, 6*a* and 7*a*, it is an object of the present invention for the golfer 200 to swing training element 30 past the golfer's lead leg 203, while maintaining a 90° angle between the golfer's lead arm 205 and shaft 102 of golf club 100. Additionally, as mentioned above, it is an object of the present invention for the golfer 200 to swing training element 30 past the golfer's lead leg 203 while moving golf club 100 on an identical direction to the target line, so that the club head 106 is positioned to hit golf ball 202 straight. It is also an object of the present invention for the golfer 200 to swing training element 30 past lead leg 203 and swing the club head 106 directly on the shaft plane established at address, so that the club path is directly on plane.

While particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made thereto without departing from the spirit and scope of the invention.

What is claimed is:

1. A golf training aid for improving a golfer's golf swing, insertable into a grip end of a shaft of a golf club, comprising:

an elongated rod having a first end and an opposite second end, with said first end and at least a portion of said rod being received within the hollow shaft of the golf club and with said second end of said rod disposed outwardly beyond the grip end of the shaft of the golf club;

a hollow, tubular sleeve having a first end and an opposite second end, said sleeve being connected to the grip end of the shaft of the golf club, with said first end and a portion of said sleeve received within the hollow shaft of the golf club and with said second end and a portion of said sleeve being disposed above the grip end of the shaft of the golf club, wherein said sleeve is configured and dimensioned to permit said rod to slide within said sleeve when solely under the influence of gravity; and a training element connected to said second end of said rod, said training element being of a sufficient dimension and configuration to effect sliding movement of said rod when under the influence of gravity when the golf club is swung;

whereby said rod is slidably moveable from a retracted position to an extended position during a golf swing solely via gravity acting on said rod and said training element, wherein when the golf club is positioned at address relative to a golf ball, said rod is in said retracted position whereby said training element is disposed generally adjacent to the grip end of the shaft of the golf club and a predetermined portion of said rod is received within the shaft of the golf club, and wherein when the golf club is moved into a backswing prior to striking a golf ball, said rod slidably moves from said retracted position into said extended position solely via gravity acting on said rod and said training element, whereby said predetermined portion of said rod is extended outwardly beyond the grip end of the shaft of the golf club and said training element is spaced apart from the grip end of the shaft of the golf club, and wherein when the golf club is moved into a downswing prior to striking a golf ball, said rod and said training element maintain said extended position and said training element is swung past the golfer's lead leg on the downswing, so that the hands of the golfer are aligned with the trail leg of the golfer when the shaft of the golf club is parallel to the ground, before the golf club makes contact with the golf ball, if the golf swing is properly performed.

2. The training aid according to claim 1, wherein:

said rod and said training element are aligned with and slidably move along a generally centrally disposed longitudinally extending axis of the shaft of the golf club.

3. The training aid according to claim 1, wherein:

said training element is a member selected from the group consisting of generally cylindrical-shaped and generally spherical-shaped.

4. The training aid according to claim 1, wherein:

said rod is removably insertable into the grip end of the shaft of the golf club.

5. The training aid according to claim 1, further comprising:

a flute connected to said sleeve and disposed outwardly from and adjacent to the grip end of the shaft of the golf club, wherein said training element is seated within said flute in said retracted position and said training element is spaced apart from said flute in said extended position.

6. The training aid according to claim 5, wherein:

said flute comprises an outer concave first surface, an opposite convex second surface, and defines an opening generally in the center thereof in which said rod is slidably received.

7. The training aid according to claim 1, wherein:

said sleeve has a first angled end and said first end of said rod has a tapered tip, to ease insertion of said rod and said sleeve into the grip end of the shaft of the golf club.

8. The training aid according to claim 7, wherein:

said means for slidably connecting said rod to the grip end of the shaft of the golf club comprises said tip and said sleeve, wherein said tip has a diameter which is greater than a diameter of said sleeve.

9. The training aid according to claim 1, wherein:

said sleeve has an outwardly extending barb formed thereon, to secure said sleeve to the grip end of the shaft of the golf club.

10. The training aid according to claim 1, wherein:

said rod moves from said retracted position into said extended position with ease on the backswing.

11. The training aid according to claim 1, wherein:

in said extended position, said training element is disposed in the range of approximately 12-14" from the grip end of the shaft of the golf club and in said retracted position, said training element is disposed in the range of approximately 2-3" from the grip end of the shaft of the golf club.

12. A golf training aid assembly for improving a golfer's golf swing, comprising:

a golf club having a shaft with a first end with a club head and an opposite second grip end with a club grip; and a golf training aid for improving a golfer's golf swing, inserted into said grip end of said shaft of said golf club, comprising an elongate rod having a first end and an opposite second end, with said first end and at least a portion of said rod being received within said hollow shaft of said golf club and with said second end of said rod disposed outwardly beyond said grip end of said shaft of said golf club; a hollow, tubular sleeve having a first end and an opposite second end, said sleeve being connected to said grip end of said shaft of said golf club, with said first end and a portion of said sleeve received within said hollow shaft of said golf club and with said second end and a portion of said sleeve being disposed above said grip end of said shaft of said golf club, wherein said sleeve is configured and dimensioned to permit said rod to slide within said sleeve when solely under the influence of gravity; and a training element connected to said second end of said rod, said training element being of a sufficient dimension and configuration to effect sliding movement of said rod when under the influence of gravity when said golf club is swung;

whereby said rod is slidably moveable from a retracted position to an extended position during a golf swing solely via gravity acting on said rod and said training element, wherein when said golf club is positioned at address relative to a golf ball, said rod is in said retracted position whereby said training element is disposed generally adjacent to said grip end of said shaft of said golf club and a predetermined portion of said rod is received within said shaft of said golf club, and wherein when said golf club is moved into a backswing prior to striking a golf ball, said rod slidably moves from said retracted position into said extended position solely via gravity acting on said rod and said training element, whereby said predetermined portion of said rod is extended outwardly beyond said grip end of said shaft of said golf club and said training element is spaced apart from said grip end of said shaft of said golf club, and wherein when said golf club is moved into a downswing prior to striking a golf ball, said rod and said training element maintain said extended position and said training element is swung past the golfer's lead leg on the downswing, so that the hands of the golfer are aligned with the trail leg of the golfer when the shaft of the golf club is parallel to the ground, before the golf club makes contact with the golf ball, if the golf swing is properly performed.

13. The assembly according to claim 12, wherein:

said rod is removably insertable into said grip end of said shaft of said golf club.

14. The assembly according to claim 13, wherein:

said club grip has a closed end defining an opening therein on said grip end of said shaft of said golf club, and wherein said sleeve and said rod are received within said opening.

15. The assembly according to claim 14, wherein:

said sleeve has a first angled end and said first end of said rod has a tapered tip, to ease insertion of said rod and said sleeve into said opening defined in said grip end of said shaft of said golf club.

16. A method of training for golf, comprising the steps of:

providing a golf club having a shaft with a first end with a club head and an opposite second grip end with a club grip;

providing a golf training aid for improving a golfer's golf swing, inserted into said grip end of said shaft of said golf club, comprising an elongate rod having a first end and an opposite second end; means for slidably connecting said rod to said grip end of said shaft of said golf club, which are configured and dimensioned to permit said rod to slide when solely under the influence of gravity, with said first end and at least a portion of said rod being received within said hollow shaft of said golf club and with said second end of said rod disposed outwardly beyond said grip end of said shaft of said golf club; and a training element connected to said second end of said rod, said training element being of a sufficient dimension and configuration to effect sliding movement of said rod when under the influence of gravity when said golf club is swung, whereby said rod is slidably moveable from a retracted position to an extended position during a golf swing solely via gravity acting on said rod and said training element;

positioning said golf club at address relative to a golf ball, whereby said rod is in said retracted position with said training element disposed generally adjacent to said grip end of said shaft of said golf club and a predetermined portion of said rod being received within said shaft of said golf club;

moving said golf club into a backswing prior to striking a golf ball, whereby said rod slidably moves from said retracted position into said extended position solely via gravity acting on said rod and said training element, with said predetermined portion of said rod being extended outwardly beyond said grip end of said shaft of said golf club and said training element being spaced apart from said grip end of said shaft of said golf club; and moving said golf club into a downswing prior to striking a golf ball, whereby said rod and said training element maintain said extended position and said training element is swung past the golfer's lead leg on the downswing, so that the hands of the golfer are aligned with the trail leg of the golfer when the shaft of the golf club is parallel to the ground, before the golf club makes contact with the golf ball, if the golf swing is properly performed.

17. The method according to claim 16, further comprising:

providing a hollow, tubular sleeve connectable to said grip end of said shaft of said golf club, and said club grip has a closed end defining an opening therein on said grip end of said shaft of said golf club, and said method further comprises the step of inserting said sleeve and said first end of said rod into said opening.

* * * * *